US005253809A

United States Patent [19]

Poppitz et al.

[11] Patent Number: 5,253,809

[45] Date of Patent: Oct. 19, 1993

[54] SPINNER ASSEMBLY FOR FLUID CLEANER

[75] Inventors: Harold A. Poppitz, Savage; Harold A. Petsch, Excelsior, both of Minn.

[73] Assignee: Chaska Chemical Co., Savage, Minn.

[21] Appl. No.: 947,555

[22] Filed: Sep. 21, 1992

[51] Int. Cl.[5] ..... B05B 1/30; B05B 3/06

[52] U.S. Cl. ..... 239/257; 239/256; 239/251; 134/179; 15/50.1

[58] Field of Search ..... 239/251, 256, 257; 134/179; 15/50.1

[56] References Cited

U.S. PATENT DOCUMENTS

| | | | |
|---|---|---|---|
| 2,021,710 | 11/1935 | Wilson | 239/256 X |
| 2,574,874 | 11/1951 | Koeppel | 239/257 X |
| 3,038,667 | 6/1962 | Sandie | 239/257 |
| 3,748,050 | 7/1973 | Poppitz | 239/251 X |
| 3,829,019 | 8/1974 | Petsch | 239/251 |
| 3,832,069 | 8/1974 | Petsch | 239/251 X |

*Primary Examiner*—Andres Kashnikow
*Assistant Examiner*—Lesley D. Morris
*Attorney, Agent, or Firm*—Burd, Bartz & Gutenkauf

[57] ABSTRACT

A cleaning apparatus having a pan-shaped housing used to clean surfaces. Mounted on the top of the housing is a spinner assembly having a body containing a longitudinal passage. A tubular shaft rotatably mounted in the passage carries tubular arms located within the housing. The fluid flows from the hollow shaft into the arms and is discharged through nozzles having orifices mounted on the ends of the arms. The shaft has a head located in a chamber at one end of the passage. The diameter of the head is larger than the diameter of the passage and is dynamically balanced by the flow of fluid under pressure through the passage and chamber into the hollow shaft. The rotating shaft is laterally stabilized with a cylindrical boss attached to a cap threaded on the body. Alternatively, the upper end of the shaft has a cylindrical projection rotatably mounted in a recess in the cap to eliminate lateral movement and vibration of the shaft. A bolt threaded into a connector attaching one of the nozzles to an arm is adjustable to regulate liquid flow rate through the cleaning apparatus.

22 Claims, 5 Drawing Sheets

SPINNER ASSEMBLY FOR FLUID CLEANER

FIELD OF THE INVENTION

The invention relates to apparatus used in high pressure fluid cleaning applications.

BACKGROUND OF THE INVENTION

High fluid pressure cleaning equipment has been utilized to direct cleaning solutions to the surfaces to be cleaned. A cleaning apparatus having a spinner assembly to discharge fluid under pressure to a desired location is disclosed by Petsch in U.S. Pat. No. 3,829,019. The spinner assembly has a tubular shaft rotatably mounted in a sleeve bearing. The shaft carries long arms through which high pressure fluid flows and is discharged through nozzles attached to the outer ends of the arms. The arms reach high RPM rates due to the movement of the high pressure fluid through the arms and out angled orifices in the nozzles of the cleaning apparatus. At times the shaft is displaced laterally and vibrates from the speed of the rotating arms causing excessive wear on the bearing. When the bearing wears the fluid under pressure leaks and the shaft seizes up and will bend up under pressure. Material will also wear the outer surface of the shaft. Radial destruction of the liquid pressure about the boss point also occurs. This increases maintainance requirements for the apparatus. It is necessary to use two twenty-inch disks to prevent premature bearing failure. This double structure increases costs of manufacture of the cleaning apparatus. Further, the high RPM rate of the arms causes less direct impact of the cleaning solution with the surface to be cleaned. Accordingly, a large quantity of water is used in the cleaning procedure.

SUMMARY OF THE INVENTION

The invention is directed to an improved cleaning apparatus for discharging fluid under pressure to a specific location to be cleaned. The apparatus has a housing including a body mounted on the housing. The body has a longitudinal passage rotatably carrying a shaft means. The shaft means has a longitudinal passage and a head located in the chamber open to the passage in the body. The head is subjected to fluid under pressure in opposite longitudinal directions to dynamically balance the shaft means on the body. The shaft means is connected to a fluid discharging means which rotates the shaft means and discharges fluid under pressure. The body has stabilizing means that cooperates with the shaft means to eliminate lateral displacement and vibration of the shaft means when the fluid discharging means rotates the shaft means. The fluid discharging means includes nozzles having groove means that provide fluid discharge openings for directing jet streams of cleaning fluid toward the surface to be cleaned. The groove means can be angled to control the speed of rotation of the fluid discharging means. A bolt threaded into the nozzle connector is adjustable to regulate flow of fluid through the fluid discharging means thereby regulating the rotational speed of the fluid discharging means and shaft means. Reducing the speed of rotation of the shaft means increases bearing life. The lower rotational speed of the fluid discharge means results in a greater direct impact force of the liquid against the surface to be cleaned. This increases cleaning efficiency and conserves water.

DESCRIPTION OF THE PREFERRED EMBODIMENTS

Figure 1:
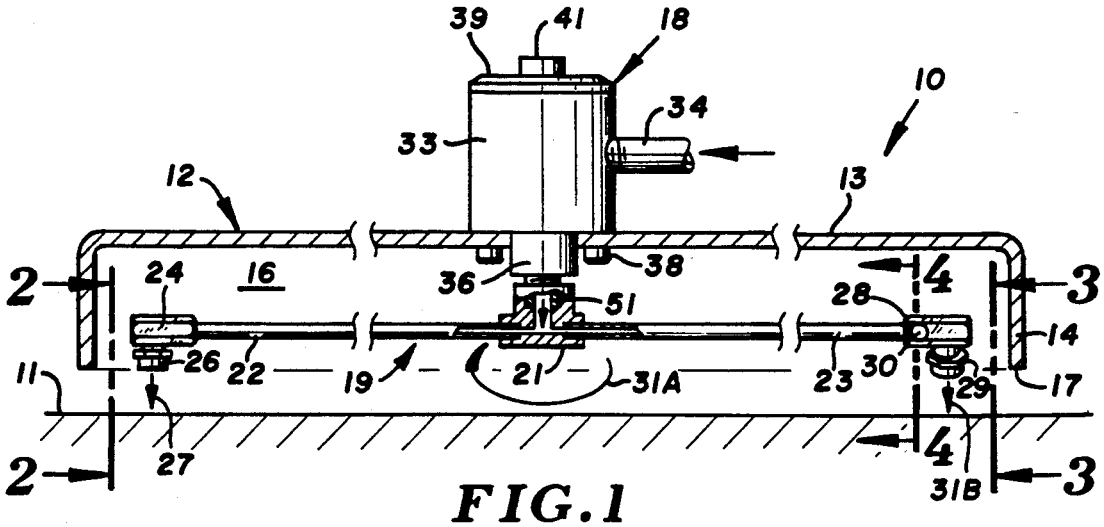
FIG. 1 is a foreshortened side elevational view, partly sectioned of a fluid pressure cleaner of the invention.

Referring to FIG. 1, there is shown a fluid pressure cleaner indicated generally at 10, useable on a surface 11 to be cleaned. Cleaner 10 functions to dispense high pressure fluid, such as a cleaning solution, onto surface 11 and mechanically scrub the surface to effect a cleaning operation. Cleaner 10 can be used to clean surfaces such as upright walls, ceilings, floors and outside surfaces of trucks and buses, highway signs, buildings, swimming pools and the like. Cleaner 10 is a portable unit that can be readily moved and used in numerous places, including but not limited to food processing, meat packing, dairy processing and the like. The discharge end of cleaner 10 has a cleaning head or housing 12 connected to the end of an elongated handle (not shown). The cleaning solution used is preferably water added to an acid solution. Cleaner 10 can also be used for high pressure rinsing with water in the range of 800 to 1000 psi.

Housing 12 is a generally square, pan-shaped member having a substantially flat top wall 13 joined to a continuous side wall 14. The housing can have other shapes, such as rectangular, circular, triangular, hexagonal or octagonal shapes. The lower or outer edge of side wall 14 terminates in a continuous bottom edge 17. Bottom edge 17 lies in a generally horizontal plane that is spaced from top wall 13 to define a chamber 16. Edge 17 of housing 12 is located at a generally uniform and close distance to surface 11 which is being cleaned.

Figure 6:
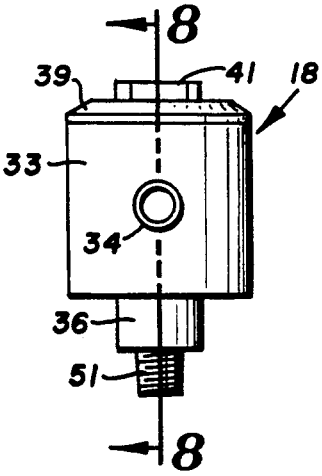
FIG. 6 is a side elevational view of FIG. 5.
Figure 7:
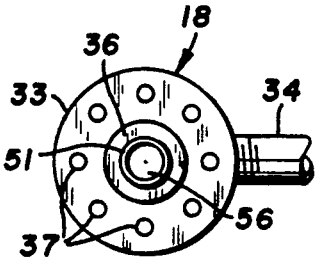
FIG. 7 is a bottom plan view of FIG. 5.
Figure 8:
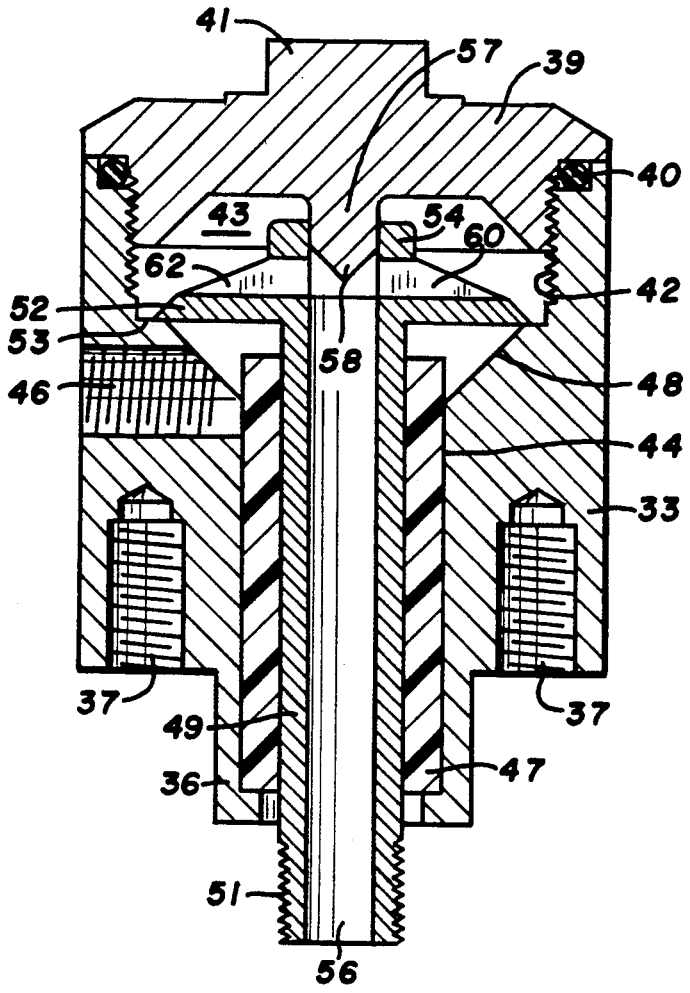
FIG. 8 is an enlarged sectional view taken along line 8—8 of FIG. 6.

Mounted in the center portion of top wall 13 is a spinner assembly indicated generally at 18. Cleaning fluid under pressure is supplied to spinner assembly 18 through a tubular hose 34, as shown in FIGS. 1 and 6. Spinner assembly 18 has a short, upright cylindrical body 33. The lower end of body 33 is attached to top wall 13 with a plurality of bolts 38. Bolts 38 extend through top wall 13 and are threaded into threaded holes 37 in body 33, shown in FIG. 7, to attach spinner assembly 18 to housing 12. As shown in FIG. 8, body 33 has a central longitudinal passage 44. An elongated sleeve bearing 47 is located in a substantial portion of passage 44. An elongated tubular shaft 49 is rotatably mounted on bearing 47. Bearing 47 preferably is made of low-friction plastic material, such as nylon, and has self-lubricating characteristics with respect to the material of shaft 49. A boss 36 o the bottom of body 33 has an inwardly directed annular lip engaging the lower end of bearing 47 to hold the bearing within passage 44. Shaft 49 has a longitudinal passage 56 for carrying cleaning fluid under pressure into the inside of housing 12. Secured to the upper end of shaft 49 is an enlarged head 52. Head 52 is located in an enlarged chamber 43 at the upper end of body 33.

Figure 5:
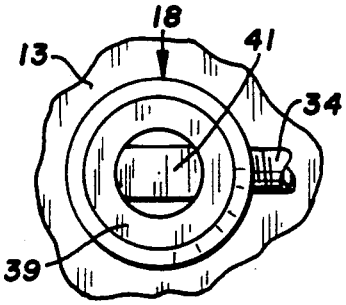
FIG. 5 is an enlarged top view of the spinner assembly on the cleaner of FIG. 1.
Figure 9:
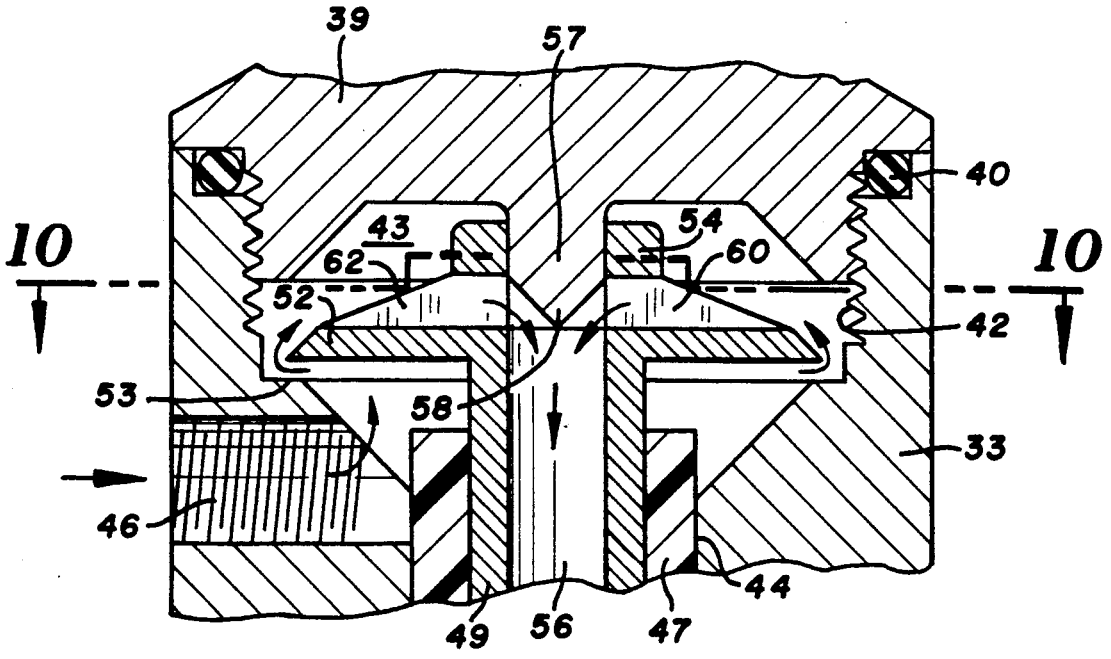
FIG. 9 is an enlarged sectional view of the spinner head subjected to fluid under pressure.
Figure 10:
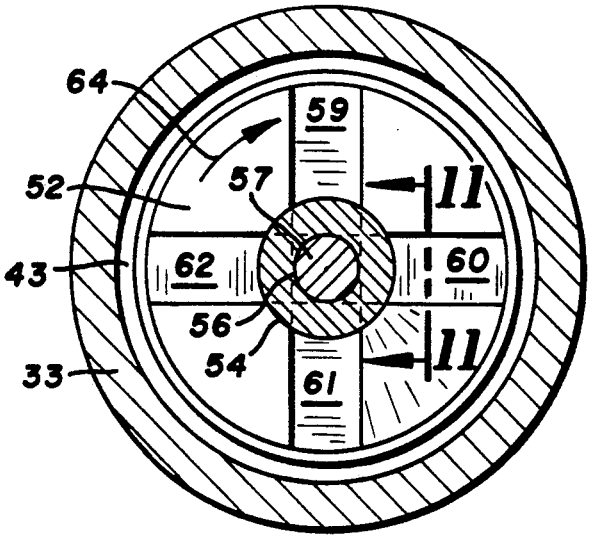
FIG. 10 is a reduced sectional view taken along line 10—10 of FIG. 9.
Figure 11:
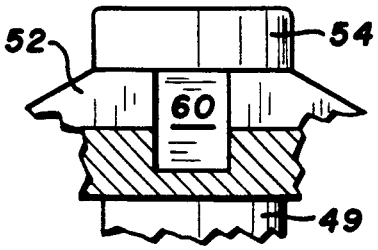
FIG. 11 is an enlarged sectional view taken along line 11—11 of FIG. 10.

As shown in FIGS. 9, 10 and 11, a plurality of radial, circumferentially spaced grooves 59, 60, 61 and 62 in the top of head 52 connect chamber 43 with the top of passage 56. Grooves 59-62 lead from chamber 43 to the center of passage 56. There can be two, three, four or more grooves in head 52. The outer peripheral face of head 52 has an upwardly and inwardly tapered shape to permit the free flow of cleaning fluid through passage 56. A plug or cap 39 has a lower threaded end that engages the inside threaded side wall 42 of body 33 to close the top of chamber 43. A centrally located cylindrical boss 57 extending downwardly from the inner surface of cap 39 has a cone-shaped lower end 58 that projects into the top of passage 56 to laterally stabilize shaft 49 when shaft 49 rotates on sleeve bearing 47. A ring 54 secured to the top of head 52 surrounds boss 57 adjacent end 58 to maintain alignment of boss 57 with passage 56. An annular seal or O-ring 40 surrounds cap 39 adjacent the upper end of body 33. Cap 39 has a centrally located head 41 having flat sides, as shown in FIG. 5, to facilitate the tightening of cap 39 on body 33. Head 52 has an annular flat bottom surface having an outer peripheral portion that faces a flat annular shoulder 53 on body 33. The bottom surface of head 52 and shoulder 53, when in engagement with each other, as shown in FIG. 8, limit the axial movement of shaft 49 in passage 44. The surface area of the annular bottom face of head 52 is substantially equal to the cross sectional area of shaft 49 whereby the pressure of the fluid in chamber 43 acting on head 52 longitudinally balances shaft 49 in body 33.

The upper portion of body 33 has a lateral threaded bore or port 46 accommodating the threaded end of hose 34. Cleaning fluid under pressure flows through hose 34 and into chamber 43 via port 46. Fluid moves upwardly in chamber 43 and places an axial upward force on head 52. Chamber 43 has a cone-shaped bottom wall 48 to facilitate the upward movement of fluid in the chamber. This fluid under pressure will separate the bottom surface of head 52 from shoulder 53 of body 33. The flowing fluid adjacent the bottom surface of head 52 serves as an annular fluid thrust bearing that reacts against longitudinal movement of shaft 49. Lower end 58 of boss 57 extends through ring 54 and into the top of shaft passage 56 to laterally stabilize shaft 49. Fluid flows around the outer peripheral edge of head 52 through grooves 59-62 and into the top of shaft passage 56. The forces of fluid under pressure in the lower portion of chamber 43 acting in an upward direction against head 52 are substantially equal to the forces in the upper portion of chamber 43 acting downwardly on head 52. These opposite fluid forces on head 52 dynamically balance shaft 49 longitudinally on body 33 and permit substantially free rotation of shaft 49 on bearing 47, as shown by arrow 64 in FIG. 10. As shown in FIG. 9, boss 57 projects through ring 54 and into shaft passage 56 to prevent lateral movement and vibration of shaft 49 when shaft 49 is rotated by liquid distributor 19 thereby further decreasing wear on bearing 47. This lateral stabilization of shaft 49 with downwardly extending boss 57 enables use of elongated distributor arms having lengths of up to 36 inches without effecting the longevity of the useful life of bearing 47. Shaft 49 has a substantial surface in bearing engagement with sleeve bearing 47. The fit between shaft 49 and bearing 47 is a rotational close fit sufficient to prevent leakage of fluid under pressure from spinner assembly 18.

Referring to FIGS. 1 and 8, a liquid distributor indicated generally at 19, secured to spinner assembly 18 is used to distribute liquid under pressure to the surface to be cleaned. Liquid distributor 19 has a hub 21 located under top wall 13 of housing 12. Hub 21 is mounted on lower threaded end 51 of shaft 49. Hub 21 has a pair of oppositely directed lateral bores accommodating outwardly projected tubular arm members 22 and 23. Nozzles 26 and 29 are attached to the outer ends of arms 22 and 23 with connectors 24 and 28. Each nozzle 26, 29 has a fluid discharge opening or orifice operable to direct a jet curtain of fluid under pressure as indicated by arrows 27 and 31B, shown in FIGS. 2 and 3, respectively, toward surface 11 to be cleaned.

Figure 2:
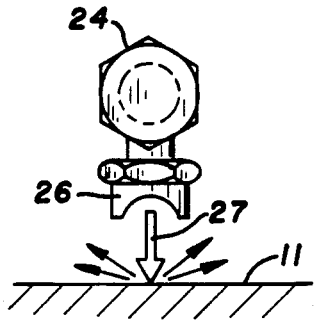
FIG. 2 is an enlarged view taken along line 2—2 of FIG. 1.

Connector 24, as shown in FIGS. 1 and 2, is a one-piece member having an elongated body with an outer, hexagonal-shaped peripheral surface to accommodate a wrench. A passage extends through connector 24. The portion of the body of connector 24 surrounding the inner end of the passage of connector 24 is threaded to accommodate the threads on the outer end of arm 22. Nozzle 26 is threaded on the downwardly directed tubular end of connector 24. The inner end of nozzle 26 has a hexagonal-shaped outer surface to facilitate the tightening of nozzle 26 on connector 24. The discharge orifice of nozzle 26 is a transverse slot extending from the sides of nozzle 26 and is open to the passage of connector 24. As shown in FIG. 2, nozzle 26 is downwardly directed at an angle of approximately 90 degrees with respect to the horizontal or longitudinal axis of the passage of connector 24. The jet 27 of cleaning fluid is discharged as a substantially flat curtain of high pressure fluid from nozzle 26 toward surface 11 to be cleaned. The direct discharge of the cleaning fluid from nozzle 26 toward surface 11 increases cleaning efficiency of cleaner 10. Also, less fluid is needed to clean surface 11.

Figure 3:
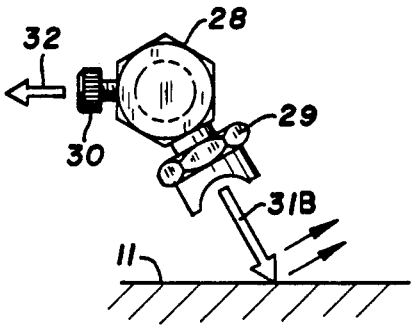
FIG. 3 is an enlarged view taken along line 3—3 of FIG. 1.
Figure 4:
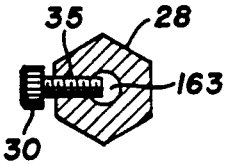
FIG. 4 is an enlarged sectional view taken along line 4—4 of FIG. 1.

Connector 28, as shown in FIGS. 1, 3 and 4, has substantially the same structure as connector 24. Connector 28 has an elongated body with a hexagonal-shaped outer surface to accommodate a wrench. A passage 163 extends through connector 28. The portion of the body of connector 28 surrounding the inner end of passage 163 has inner threads to accommodate threads on the outer end of arm 23. Nozzle 29 is threaded on the downwardly directed tubular end of connector 28. The inner end of nozzle 29 has a hexagonal-shaped outer surface to facilitate the tightening of nozzle 29 on connector 28. Nozzle 29 has a discharge orifice or transverse slot extending from opposite sides of nozzle 29. The slot is open to passage 163 of connector 28. As shown in FIG. 3, nozzle 29 is inclined downwardly at an angle of approximately 45 degrees with respect to the horizontal or longitudinal axis of passage 163. The size of passage 163 is controlled by a bolt 30 threaded through a threaded hole 35 in the side wall of connector 28. Bolt 30 is adjustable to extend into passage 163 to regulate the size of passage 163 thereby control flow of liquid through cleaner 10. An optimal cleaning efficiency with minimized liquid expenditure can be achieved by regulating flow rate of liquid through cleaner 10 thereby regulating rotational speed of liquid distributor 19 with adjustment of bolt 30 and the angle of inclination of nozzle 29. Bolt 30 can be used to decrease flow of liquid through connector passage 163 to a rate whereby liquid distributor 19 has a slower rotation to increase cleaning action due to increased direct liquid impact force. The speed of rotation of liquid distributor 19 may also be controlled by adjusting the angle nozzle 29 inclines downwardly with respect to the horizontal or longitudinal axis of connector passage 163. Increased cleaning efficiency is achieved by slowing the rotational speed of liquid distributor 19 with movement of nozzle 29 into a more direct orientation with surface 11 to be cleaned. High speed rotation causing less direct liquid impact force and less cleaning action is avoided. Also, reducing the speed of rotation of liquid distributor 19 reduces the rotational speed of spinner assembly 18 and results in a decrease in wear on bearing 47. Bolt 30 can be threaded outwardly, as indicated by arrow 32 in FIG. 3, to increase liquid flow rate through distributor 19 when extraordinary cleaning action is desired. Also, nozzles 26 and 29 can have larger discharge openings for greater cleaning action, such as openings to allow five gallons of water at 1000 psi.

In use, jet 31B of cleaning fluid is discharged as a substantially flat curtain of high pressure fluid at an angle from nozzle 29 toward surface 11 to be cleaned. The angular discharge of the cleaning fluid provides nozzle 29 with a horizontal force component which rotates arms 22 and 23, hub 21 connected to the arms, and shaft 49 connected to the hub in the direction of arrow 31A, shown in FIG. 1. Jet 27 of cleaning fluid is discharged as a substantially flat curtain of high pressure fluid directly at surface 11 creating a direct liquid impact force resulting in maximum cleaning action. The angle of inclination of jet 31B and the rate of flow of liquid through cleaner 10 can be changed to vary the rotational speed of liquid distributor 19 and spinner assembly 18 thereby increasing cleaning efficiency and reducing bearing wear and water use.

Figure 12:
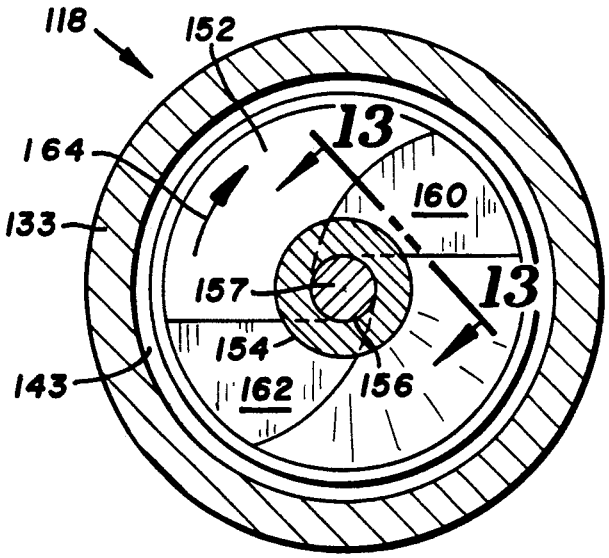
FIG. 12 is a sectional view similar to FIG. 10 of a modification of the spinner head of the spinner assembly.
Figure 13:
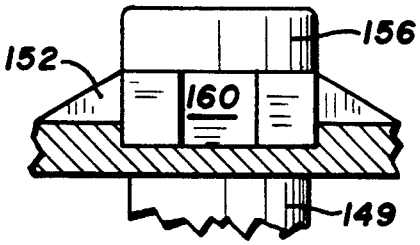
FIG. 13 is an enlarged sectional view taken along the line 13—13 of FIG. 12.

Referring to FIGS. 12 and 13, there is shown a modification of the spinner assembly indicated generally at 118, useable with the fluid pressure cleaner of the invention. Spinner assembly 118 has a cylindrical body 133 having an elongated tubular shaft 149 rotatably mounted on a sleeve bearing (not shown). Shaft 149 has a longitudinal passage 156 for carrying cleaning fluid under pressure into the inside of the cleaner housing. Secured to the upper end of shaft 149 is an enlarged head 152. Head 152 is located in a chamber 143 at the upper end of body 133. A pair of oppositely directed grooves 160 and 162 in head 152 connect chamber 143 with the top of passage 156. Head 152 can have two, three, four or more grooves. A plug or cap (not shown) threaded on body 133 closes the top of chamber 143. A centrally located cylindrical boss 157 extending from an inside portion of the cap projects into the top of passage 156 through a ring 154 secured to the top of head 152 to laterally stabilize shaft 149 when shaft 149 rotates on the sleeve bearing of spinner assembly 118. Ring 154 surrounds boss 157 adjacent the outer end of boss 157 to maintain alignment of boss 157 with passage 156.

Oppositely directed grooves 160 and 162 in the top of head 152 lead from chamber 143 to the center of passage 156. The outer peripheral face of head 152 has an upwardly and inwardly tapered shape to permit free flow of cleaning fluid through passage 156. Fluid moves upwardly in chamber 143 and places an axial upward force on head 152. Flowing fluid adjacent the bottom surface of head 152 serves as an annular fluid thrust bearing that reacts against longitudinal movement of shaft 149. Boss 157 extends through ring 154 and into the top of shaft passage 156 to further stabilize shaft 149. Fluid flows around the outer peripheral edge of head 152 through grooves 160 and 162 and into passage 156. The forces of fluid under pressure in the lower portion of chamber 143 acting in an upward direction against head 152 are substantially equal to the forces in the upper portion of chamber 143 acting downwardly on head 152. These opposite fluid forces on head 152 dynamically balance shaft 149 longitudinally on body 133 and permit substantially free rotation of shaft 149 on the sleeve bearing of spinner assembly 118, as indicated by arrow 164 in FIG. 12. Boss 157 extends through ring 154 and into the top of shaft passage 156 to eliminate lateral displacement and vibration of shaft 149 during rotation of shaft 149. This stabilization of shaft 149 decreases wear on the bearing of spinner assembly 118 resulting in lower maintenance and replacement costs.

Figure 14:
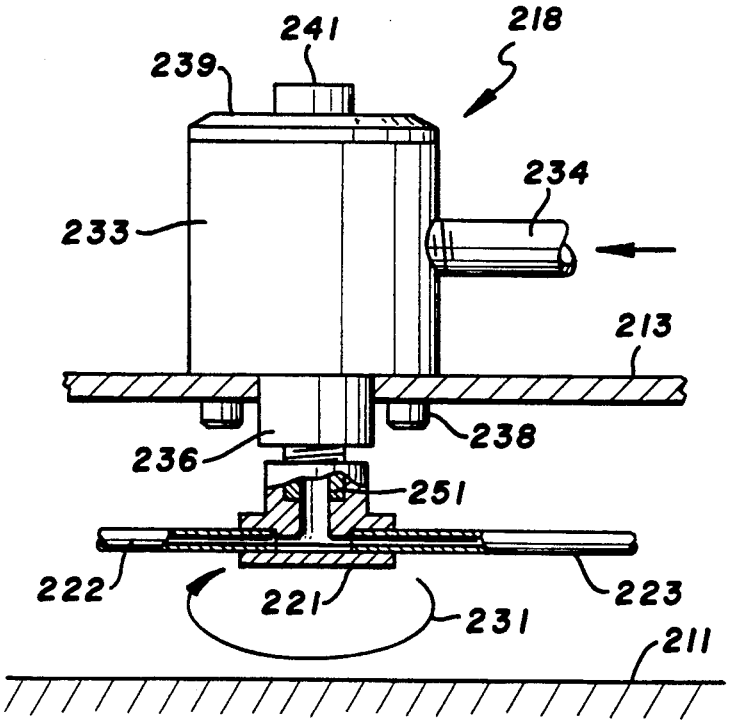
FIG. 14 is a side elevational view, partly sectioned similar to FIG. 1 of a second modification of the spinner assembly of the cleaner.

Referring to FIGS. 14 to 20, there is shown a second modification of the spinner assembly indicated generally at 218, for the fluid pressure cleaner of the invention. The cleaner functions to dispense high pressure fluid, such as a cleaning solution, onto surface 211 to be cleaned and mechanically scrub the surface to effect a cleaning operation. The cleaner has a housing having a substantially flat top wall 213. Mounted in the center portion of top wall 213 is spinner assembly 218. Cleaning fluid under pressure is supplied to spinner assembly 218 through a tubular hose 234, as shown in FIG. 14. Spinner assembly 218 has a short, upright cylindrical body 233. The lower end of body 233 is attached to top wall 213 with a plurality of bolts 238. Bolts 238 extend through top wall 213 and are threaded into threaded holes 237 in body 233, shown in FIG. 16, to attach spinner assembly 218 to housing top wall 213.

Figure 17:
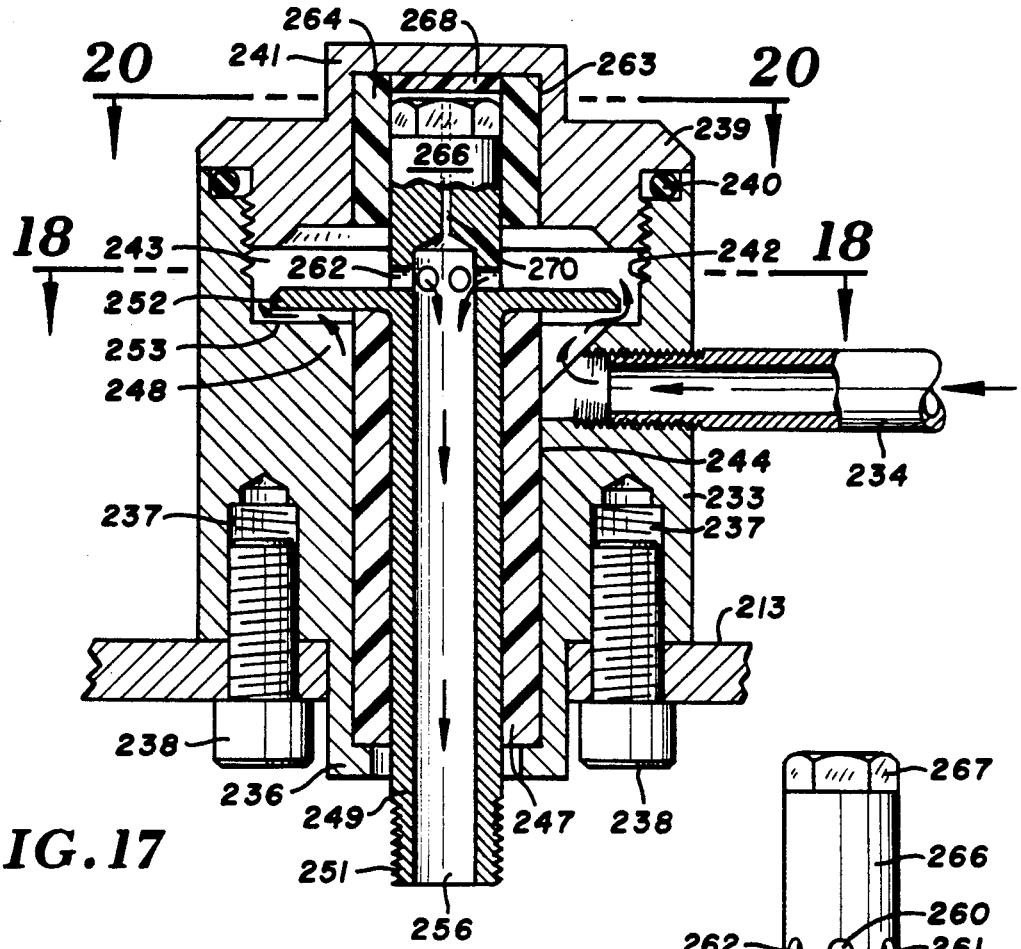
FIG. 17 is an enlarged sectional view taken along line 17—17 of FIG. 15.

Referring to FIG. 17, body 233 has a central longitudinal passage 244. An elongated sleeve bearing 247 is located in a substantial portion of passage 244. An elongated tubular shaft 249 is rotatably mounted on bearing 247. Bearing 247 preferably is made of low-friction plastic material, such as nylon, and has self-lubricating characteristics with respect to the material of shaft 249.

Figure 19:
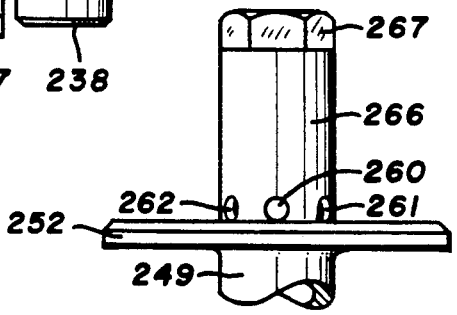
FIG. 19 is a side elevational view of the spinner head and spinner projection of the spinner assembly of FIG. 14.
Figure 18:
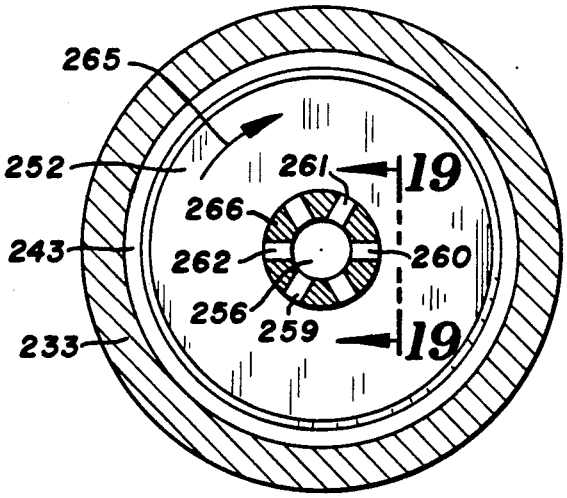
FIG. 18 is a sectional view taken along line 18—18 of FIG. 17.

A boss 236 on the bottom of body 233 has an inwardly directed annular lip engaging the lower end of bearing 247 to hold bearing 247 within passage 244. Shaft 249 has a longitudinal passage 256 for carrying cleaning fluid under pressure into the inside of the cleaner housing. Secured to the upper end of shaft 249 is an enlarged head 252 having an upwardly extending cylindrical projection 266. Head 252 is located in an enlarged chamber 243 at the upper end of body 233. A plurality of radial, circumferentially spaced holes 259, 260, 261 and 262 in the lower portion of projection 266 adjacent head 252 connect chamber 243 with the top of passage 256. As shown in FIGS. 17, 18 and 19, radial holes 259–262 lead from chamber 243 to the center of passage 256. The outer peripheral face of head 252 has an upwardly and inwardly tapered shape to permit the free flow of cleaning fluid through passage 256. The lower portion of projection 266 can have six holes to connect chamber 243 with passage 256, as shown in FIG. 18.

Figure 15:
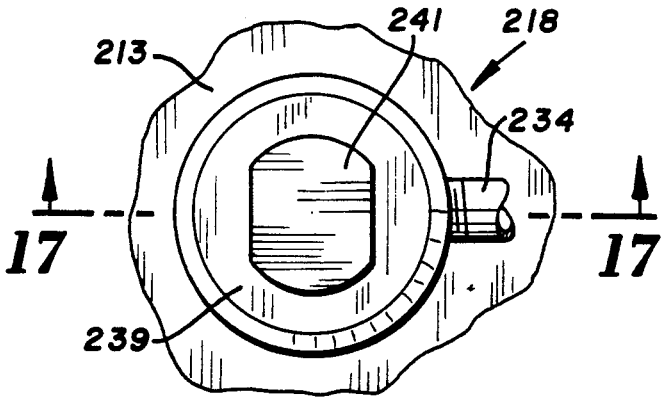
FIG. 15 is an enlarged top view of the spinner assembly of FIG. 14 mounted on the cleaner.
Figure 16:
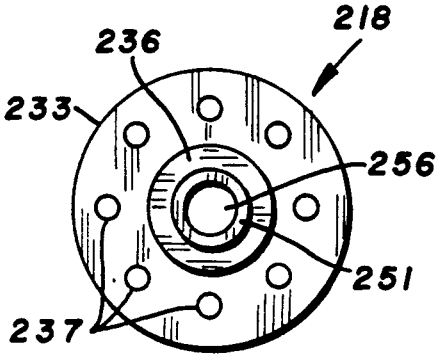
FIG. 16 is a bottom plan view of the spinner assembly of FIG. 14.
Figure 20:
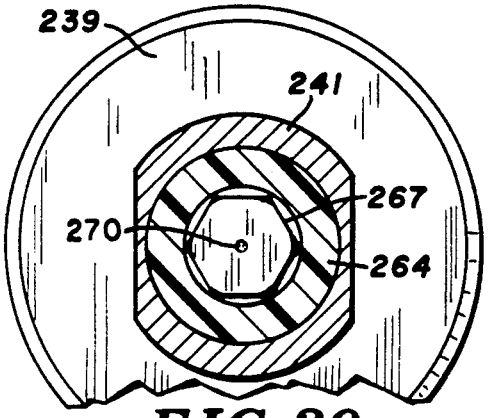
FIG. 20 is a sectional view taken along line 20—20 of FIG. 17.

A plug or cap 239 has a lower threaded end that engages the inside threaded side wall 242 of body 233 to close the top of chamber 243. A centrally located recess 263 in cap 239 accommodates a sleeve bearing 264. Cylindrical projection 266 is rotatably mounted on bearing 264. Bearing 264 preferably is made of low-friction plastic material, similar to the material of bearing 247 and has self-lubricating characteristics with respect to the material of projection 266. Projection 266 has a hexagonal-shaped upper end 267 to accommodate a wrench, as shown in FIG. 20. A circular plastic member 268 closes the top of sleeve bearing 264 adjacent end 267. Projection 266 laterally stabilizes shaft 249 and eliminates vibration of shaft 249 when shaft 249 is rotated. An annular seal or O-ring 240 surrounds cap 239 adjacent the upper end of body 233. Cap 239 has a centrally located head 241 having flat sides, as shown in FIG. 15, to facilitate the tightening of cap 239 on body 233. Head 252 has an annular flat bottom surface having an outer peripheral portion that faces a flat annular shoulder 253 on body 233. The bottom surface of head 252 and shoulder 253 are vertically spaced, as shown in FIG. 17. The top to bearing 247 engages the bottom surface of head 252. The surface area of the annular bottom face of head 252 is substantially equal to the cross sectional area of shaft 249 whereby the pressure of the fluid in chamber 243 acting on head 252 longitudinally balances shaft 249 in body 233.

The upper portion of body 233 has a lateral threaded bore or port accommodating the threaded end of hose 234. Cleaning fluid under pressure flows through hose 234 and into chamber 243 through the port. Fluid moves upwardly in chamber 243 and places an axial upward force on head 252. Chamber 243 has a cone-shaped bottom wall 248 to facilitate the upward movement of fluid in the chamber. The flowing fluid adjacent the bottom surface of head 252 serves as an annular fluid thrust bearing that reacts against longitudinal movement of shaft 249. Fluid flows around the outer peripheral edge of head 252 through holes 259–262 and into shaft passage 256. The forces of fluid under pressure in the lower portion of chamber 243 acting in an upward direction against head 252 are substantially equal to the forces in the upper portion of chamber 243 acting downwardly on head 252. These opposite fluid forces on head 252 dynamically balance shaft 249 longitudinally on body 233 and permit substantially free rotation of shaft 249 on bearing 247, as shown by arrow 265 in FIG. 18. Projection 266 has a substantial surface in bearing engagement with sleeve bearing 264 to eliminate lateral displacement and vibration of shaft 249 during rotation of shaft 249. Projection 266 has a small passage 270 open to the top of the projection, as seen in FIG. 20, and passage 256, as shown in FIG. 17. Passage 270 allows fluid to flow into and out of the space adjacent plastic member 268. Shaft 249 has a substantial surface in bearing engagement with sleeve bearing 247. The fit between shaft 249 and bearing 247 is a rotational close fit sufficient to prevent leakage of fluid under pressure from spinner assembly 218.

Referring to FIG. 14, a liquid distributor secured to spinner assembly 218 is used to distribute liquid under pressure to the surface to be cleaned. The liquid distributor has a hub 221 located under top wall 213 of the cleaner housing. Hub 221 is mounted on lower threaded end 251 of shaft 249. Hub 221 has a pair of oppositely directed lateral bores accommodating outwardly projected tubular arm members 222 and 223. Nozzles (not shown) attached to the outer ends of arms 222 and 223 have fluid discharge openings or orifices operable to direct jet curtains of fluid under pressure toward surface 211 to be cleaned. One jet of cleaning fluid is discharged as a substantially flat curtain of high pressure fluid at an angle from the nozzle toward surface 211 to be cleaned. This angular discharge of the cleaning fluid provides the nozzle with a horizontal force component which rotates arms 222 and 223, hub 221 connected to the arms, and shaft 249 connected to hub 221 in the direction of arrow 231, shown in FIG. 14. The other jet of cleaning fluid is discharged directly at surface 211 resulting in a direct impact force to maximize cleaning action. The rotational speed of arms 222 and 223 is adjustable to control cleaning efficiency. The angle of inclination of the jet discharge can be changed to vary the rotational speed of arms 222 and 223. Also, flow rate of liquid through the cleaner is adjustable to control the speed of rotation of arms 222 and 223. Slowing the rotational speed of arms 222 and 223 increases cleaning action due to increased direct liquid impact force against surface 211 to be cleaned. High speed rotation causing less direct liquid impact force and less cleaning action is avoided. Further, less water is needed for the cleaning process. Also, reducing the speed of rotation of arms 222 and 223 reduces the rotational speed of spinner shaft 249 thereby resulting in a decrease in wear on bearings 247 and 264. Projection 266 prevents lateral movement and vibration of shaft 249 when shaft 249 rotates thereby further decreasing bearing wear. The lateral stabilization of shaft 249 with cylindrical projection 266 enables the lengths of arms 222 and 223 to be increased without effecting the longevity of the useful bearing life.

While there have been shown and described preferred embodiments of the pressure fluid cleaner of the invention, it is understood that changes in structure, arrangement of structure, and materials may be made by those skilled in the art without departing from the invention. The invention is defined in the following claims.

We claim:

1. An apparatus for discharging fluid under pressure comprising: a body having a passage extended into the body and a chamber, one portion of the passage open to the chamber, shaft means located in the passage and rotatably mounted on the body, cap means attached to the body, body means secured to the cap means for laterally balancing the shaft means in the body, including the boss means extended into the longitudinal passage of the shaft means, the shaft means having a head located in the chamber and a longitudinal passage open to the chamber, means for carrying fluid under pressure to the passage in the body whereby fluid flows from the passage in the body into the chamber and around the head and into the passage of the shaft means, and fluid discharging means mounted on the shaft means to receive fluid from the longitudinal passage in the shaft means, the fluid discharging means being operable to rotate the shaft means in response to the discharge of fluid therefrom.

2. The apparatus of claim 1 wherein: the fluid discharging means comprises arm means secured to the shaft means, the arm means having passages for carrying fluid, and nozzle means mounted on the arm means receiving fluid from the arm means, the nozzle means having fluid discharge opening means.

3. The apparatus of claim 2 wherein: the arm means comprise a first arm and a second arm, the nozzle means having a first nozzle mounted on the first arm and a second nozzle mounted on the second arm, the first nozzle having a fluid discharge opening directed away from the direction of rotation of the arm means and the second nozzle having a fluid discharge opening means directed toward a surface to be cleaned.

4. The apparatus of claim 1 wherein: said fluid discharging means has a first nozzle having a fluid discharge opening means operable to direct fluid away from the direction of rotation of the shaft means and a second nozzle means spaced from the first nozzle means having fluid discharge opening means operable to direct fluid toward a surface to be cleaned.

5. The apparatus of claim 1 wherein: the fluid discharging means includes arm means and nozzle means mounted on the arm means with connector means, the connector means having a transverse tubular end, the nozzle means being mounted on the transverse end.

6. The apparatus of claim 1 including: sleeve bearing means located in the passage in the body rotatably mounting the shaft means.

7. The apparatus of claim 1 including: ring means secured to the head and surrounding the boss means.

8. The apparatus of claim 1 wherein: the fluid discharging means has means operable to regulate fluid flow rate and rotational speed of the fluid discharging means.

9. The apparatus of claim 1 wherein: the head has a pair of oppositely directed grooves open to the passage in the shaft means and the chamber.

10. An apparatus for discharging fluid under pressure comprising: a body having a passage extended into the body and a chamber, one portion of the passage open to the chamber, shaft means located in the passage and rotatably mounted on the body, means for laterally balancing the shaft means in the body, the shaft means having a head located in the chamber and a longitudinal passage open to the chamber, means for carrying fluid under pressure to the passage in the body whereby fluid flows from the passage in the body into the chamber and around the head and into the passage of the shaft means, fluid discharging means mounted on the shaft means to receive fluid from the longitudinal passage in the shaft means, the fluid discharging means being operable to rotate the shaft means in response to the discharge of fluid therefrom, and cap means attached to the body, the cap means having a recess open to the chamber, the means for balancing the shaft means comprising projection means extended from the head located in the recess and rotatably mounted on the cap means.

11. The apparatus of claim 10 including: sleeve bearing means located in the recess rotatably mounting the projection means.

12. The apparatus of claim 10 wherein: the projection means has a bottom portion, the bottom portion having a plurality of openings open to the passage in the shaft means and the chamber.

13. A spinner assembly comprising: a body having a passage and a chamber at one end of the passage, tubular shaft means located in the passage and rotatably mounted on the body, cap means removably mounted on the body, the cap means having a recess open to the chamber, a head secured to the tubular shaft means and located in the chamber, projection means extended from the head located in the recess and rotatably mounted on the cap means for laterally balancing the tubular shaft means in the body, means for carrying fluid under pressure to the passage whereby fluid flows from the passage into the chamber around the head and through the tubular shaft means, and fluid discharging means mounted on the tubular shaft means to receive fluid from the tubular shaft means, the fluid discharging means being operable to rotate the tubular shaft means in response to the discharge of fluid therefrom.

14. The spinner assembly of claim 13 including: sleeve bearing means located in the passage rotatably mounting the tubular shaft means.

15. The apparatus of claim 13 including: sleeve bearing means located in the recess rotatably mounting the projection means.

16. The apparatus of claim 13 wherein: the projection means has a bottom portion, the bottom portion having a plurality of openings open to the chamber.

17. The apparatus of claim 13 wherein: the fluid discharging means includes means operable to regulate fluid flow rate and rotational speed of the fluid discharging means.

18. A spinner assembly comprising: a body having a passage and a chamber at one end of the passage, a tubular shaft located in the passage and rotatably mounted on the body, cap means removably mounted on the body, the cap means including means rotatably engageable with the tubular shaft to laterally balance the tubular shaft in the body, a head secured to the shaft and located in the chamber, means for carrying fluid under pressure to the passage whereby fluid flows from the passage into the chamber around the head and through the shaft, and fluid discharging means mounted on the shaft to receive fluid from the shaft, the fluid discharging means being operable to rotate the shaft in response to the discharge of fluid therefrom, the fluid discharging means including means adjustable to regulate the fluid flow rate and the rotational speed thereof.

19. The apparatus of claim 18 wherein: the means rotatably engageable with the tubular shaft comprises a boss attached to the cap means and extended into the shaft.

20. The apparatus of claim 19 including: a ring secured to the head and surrounding the boss.

21. The apparatus of claim 12 wherein: the shaft has a cylindrical member extended from the head, the means rotatably engageable with the shaft comprising an inner surface defining a recess open to the chamber, the cylindrical member located in the recess and rotatably mounted on the inner surface.

22. The apparatus of claim 21 wherein: the inner surface includes a sleeve located in bearing engagement with the cylindrical member.

* * * * *